US008979196B2

(12) United States Patent
Simpson

(10) Patent No.: US 8,979,196 B2
(45) Date of Patent: Mar. 17, 2015

(54) REMOVABLY ENGAGED WHEELCHAIR HEADREST

(76) Inventor: William Simpson, Edmonton (CA)

( * ) Notice: Subject to any disclaimer, the term of this patent is extended or adjusted under 35 U.S.C. 154(b) by 260 days.

(21) Appl. No.: 13/370,244

(22) Filed: Feb. 9, 2012

(65) Prior Publication Data

US 2012/0200133 A1 Aug. 9, 2012

Related U.S. Application Data

(60) Provisional application No. 61/441,163, filed on Feb. 9, 2011.

(51) Int. Cl.
*A61G 5/12* (2006.01)
*A47C 7/38* (2006.01)
*A61G 5/10* (2006.01)

(52) U.S. Cl.
CPC .. *A61G 5/10* (2013.01); *A61G 5/12* (2013.01); *A61G 2005/121* (2013.01)
USPC ..... 297/230.14; 297/230.13; 297/397; 297/402; 297/440.2

(58) Field of Classification Search
USPC ..... 297/230.14, 284.5, 440.2, 397, 230.13, 297/402
See application file for complete search history.

(56) References Cited

U.S. PATENT DOCUMENTS

| | | | | | |
|---|---|---|---|---|---|
| 2,434,007 | A | * | 1/1948 | O'Dea | 297/230.14 |
| 3,226,159 | A | * | 12/1965 | Binding | 297/397 X |
| 3,497,259 | A | * | 2/1970 | Sherfey | 297/391 X |
| 3,730,589 | A | * | 5/1973 | Lane | 297/391 |
| 4,989,836 | A | * | 2/1991 | Hudson et al. | 297/391 X |
| 5,062,677 | A | * | 11/1991 | Jay et al. | 297/440.2 X |
| 5,378,041 | A | * | 1/1995 | Lee | 297/397 X |
| 5,897,167 | A | * | 4/1999 | Keith | 297/397 |
| 2011/0260519 | A1 | * | 10/2011 | Carrigan, Sr. | 297/397 |

* cited by examiner

*Primary Examiner* — Anthony D Barfield
(74) *Attorney, Agent, or Firm* — Donn K. Harms

(57) ABSTRACT

A support frame removably engageable with a wheelchair using no fasteners or tool-requiring engagement components. The support frame is slidably engaged and disengaged to the wheelchair by vertical translation. In an engaged position the weight of the support frame and anything attached thereto is born entirely by the rigid frame of the wheelchair through a positioning of support members of the frame in a frictional engagement atop the push handles of the wheelchair. So engaged, the support frame allows for easy transfer to other wheelchairs or easy removal and engagement from a collapsible wheelchair prior to or after transport of the wheelchair in a car or vehicle.

2 Claims, 3 Drawing Sheets

REMOVABLY ENGAGED WHEELCHAIR HEADREST

BACKGROUND OF THE INVENTION

1. Field of the Invention

This application claims priority to Provisional Application No. 61/441,163 filed on Feb. 9, 2011, and incorporated herein in its entirety by reference.

The present invention relates to headrest and support assemblies and, more particularly, to a removably engageable headrest and support assembly configured for operative engagement with a wheelchair. The disclosed device is adapted to removably engage and support the weight of the headrest device itself and anything additionally engaged thereon, securely upon the handles of the chair. So supported, the device is easily disengageable for storage or for an engagement to another chair with a simple sliding engagement and no tools.

2. Prior Art

It is estimated that 1.5 million Americans residing outside of medical institutions employ manually operated wheelchairs. Reasons for wheelchair use can range from temporary injury rehabilitation to life long use from birth or after a severe injury. Users of wheelchairs are continually maintained in a seated position over extended periods of time and are offered only limited mobility. As such, wheelchair users as well as their loved ones often desire to provide the wheelchair user with the most comfortable seating experience possible.

Comfortable and ergonomic headrests in conventional chairs and other seated arrangements are extremely important for proper head and neck support where improper positioning and use can cause pain and even long term damage. This is even more true for wheelchair users who experience limited control of the neck muscles. When wheelchairs are used for temporary patient rehabilitation or when they are permanent fixtures of a person's life, the importance of proper head and neck support can make a huge difference in the person's recovery and overall quality of life.

Unfortunately, a conventional manual as well as motorized wheelchair available to the average consumer consists of a seating platform and backrest, and more often than not no specific neck or head support. Manual versions of such a chair are considered the bare minimum of medical technology for the patient and usually what insurance will buy. Without insurance such manual versions of wheelchairs are most affordable and available to average consumers.

Advancements in modern medical technology, however, have driven the evolution of the wheelchair to provide some support and some increase in the quality of life for individuals who would otherwise be fully incapacitated. These chairs can provide full body support, including neck and head, employ hydraulics and motors, and can have the ability to position the user in the standing position. Such adaptation with technology tends to increase costs, producing some with price tags in the tens of thousands of dollars. These types of chairs are employed by severely incapacitated users.

To the average consumer, be they significantly injured or just recovering from knee surgery, such expensive motorized chairs are simply unattainable. As a result, many consumers attempt to modify the conventional canvas or material supported wheelchair with attachments to fill certain needs. Head and neck support is one of those needs most sought after.

Some prior art efforts in headrest attachments are seen in full force. For example U.S. Pat. No. 3,643,996 to Carnahan, U.S. Pat. No. 4,989,836 Hudson III et al., U.S. Pat. No. 5,074,574 to Carwin, U.S. Pat. No. 5,308,028 to Kornberg, and U.S. Pat. No. 5,791,735 to Helman teach headrest assemblies that are engageable to a wheelchair, often to the structural elements such as the frame, handles, or other rigid element in a manner that does not disturb the seating or backrest platforms.

U.S. Pat. No. 4,498,704 to Hildreth teaches a slidably and removably engaged headrest assembly for a wheelchair. Although providing convenient means for removability as well as maintaining simplicity, the headrest of Hildreth is supported by a less than rigid fabric backrest of the wheelchair. Support is therefor limited to the condition and tensile strength and stretched condition of the fabric providing the backrest. Even sturdy reinforced fabric backs, after extended periods of time, can become uncomfortable if not painful to users and are in no manner adapted to support weight vertically downward.

The available devices to provide such support, however, require complex assembly with permanent or mechanical engagement of many components. The need for employment of such complicated and permanent engagement means does not easily permit removable engagement in a hospital, convalescent home, the user's home, or other settings where wheelchairs are used from patient to patient, or when neck and head support is temporarily undesirable.

Additionally, many lower cost fabric based wheelchairs collapse for transport in a vehicle or storage, and then must be expanded for use. Consequently, any device engageable to the wheel chair for head support and to support and communicate the weight of luggage, bags, or other items to the chair, must also engage with the chair and collapse, or be disengageable quickly, and without tools when the chair is to be collapsed. Once collapsed and then re-enlarged, such a device must be easily re-engaged to the chair, and then allow attachment of luggage, and coats, and purses and the like thereto so that the user or caregiver need not have to carry it at the same time as navigating with the wheelchair.

As mentioned, for many wheelchair users the chair additionally provides a means to transport their belongings such as purses, bags, backpacks, or luggage. The user conventionally places their belongings on their lap, or if possible, hangs the bag or other belongings off the push handle located on the rear of the chair. However, belongings positioned on the user lap may further limit the mobility of the user especially if the user does not have aid from a caregiver to propel the chair. Further, many chair styles do not offer push handles or other means to securely engaged belongings. Consequently, users and/or caregivers must somehow move the wheelchair while also carrying or somehow supporting their luggage, purses, coats, and other items that move with the patient which can be quite difficult and dangerous.

As such there is a continuing and unmet need for an improved removably engageable headrest and transport assembly for a wheelchair. Such a device should be easily assembled, and more importantly be easily engageable and disengageable, to any of a plurality of wheelchairs. Such a device should provide this means for easy engagement to allow for easy transfer to another chair or to allow the chair to be collapsed and re-enlarged again. Importantly, such a device should anticipate engagement to a fabric-based chair and should be configured with a contact means to the chair, whereby the weight of the device and anything attached to it is fully supported by the rigid frame without tools.

Further, such a device once engaged, should be selectively adjustable for supporting a user's head support needs as well as adapted to slidably engage upon a wide variety of wheelchairs. Finally, in so doing, such a device must still provide weight support through a contact with the frame of the chosen chair, and do so without tools or compression fittings. The device should also engage in such a manner to maintain the ergonomic comforts provided by the wheelchair to which it is engaged.

SUMMARY OF THE INVENTION

The device herein disclosed and described provides a solution for the above noted shortcomings in prior art through the provision of a headrest assembly providing head support means that can be removably engaged to a position in concert with the backrest of a wheelchair. In the particularly preferred mode, the force of downward weight of the device is fully supported by the push handles and other rigid support members engaged to the patient support fabric which are positioned toward the rear of the wheelchair.

In accordance with at least one preferred mode of the invention, the device is adapted for slidable communication with the rear of the fabric seat back or backrest portion of a conventional wheelchair. The device includes curved support members engaged to the body of the device which, in the as-used mode, rest upon the upper terminating top edge of the fabric backrest of the wheelchair and provide a means to position and maintain the device securely thereon. However, it is preferred that the curved members do not obstruct the ergonomic seating arrangement of the backrest and, thus, are free of any contact with a user while seated.

The device further employs the advantage of laterally extending support members engaged to the body of the device which, in the as-used mode, engage in a weight-bearing communication with the top surface of the push handles of the wheelchair. The support members also provide a means for additional rigid support of the device. These support members engaged by the weight of the device in a contact with the top surface of the push handles provide a means to transfer the weight of the majority of the device, as well as that of the weight of a user's head, to the rigid frame of the wheelchair. As such the device and user are supported during movement or when stationary. Yet the engagement upon the handles allows for easy disengagement of the device from the chair as needed.

In a particularly preferred mode of the device, the curved members and lateral support members described above are slidably engaged to the body of the device through pin and slot arrangements, and additionally employ a thumb screw or similar locking mechanism. In this mode, the members are provided a means for selective lateral adjustment which can be set once correct via the thumbscrew or similar mechanism located on the pin and slot. The lateral support members may further be engaged in a manner allowing them to rotate, or they may be telescopic, or both, to provide a means to adapt their engagement to the rigid body of wheelchairs and to differently configured chairs. Thereby allowing for better conformity and engagement to the top surface of the chair's push handles.

A head support means is additionally provided and is preferably slidably engaged to the body of the device and is capable of vertical and horizontal or transverse adjustments. This provides a user with almost infinite adjustability to position the head support means, in this case a head cushion, to the exact position desired for comfort and support.

It must be noted that although the preferred mode of the device described above provides a means to employ the device on any size or style of chair it is to be understood that the various support members of the device may instead be rigidly or permanently engaged to the body of the device should it be desired for permanent employment with one specific wheelchair. As such the following description and depictions are provided to merely portray the overall scope and intent of the device and should not be considered limiting.

In yet another preferred mode of the device, the body of the device, positioned behind the back rest portion of the wheelchair comprises a plurality of apertures similar to a peg-board, or keyhole shaped aperture, which serve as a means to engage hooks or other means for attachment for holding backpacks, purses, luggage, or the like. The engagement of luggage and the like allows the weight of such to be communicated through the body of the device and directly to the rigid frame of the chair, for support thereby, at the contact engagement with the top surface of the handles. This provision to engage luggage, clothing, purses, small suitcases and the like to the frame of the device, alleviates the need for the user/patient or the caregiver to carry such themselves while moving within the wheelchair. Furthermore, the apertures provide overall weight reduction in the device while still affording sufficient strength to the member providing the support for carrying other components.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

It is an object of the invention to provide a headrest assembly for a wheelchair which is removably engaged in a manner to be supported by the rigid frame components of the chair, such as the push handles which also requires no tools or brackets.

It is another object of the invention to provide such a headrest assembly that does not restrict the seating nature and maintains the ergonomic standards of the wheelchair.

Still another object of the invention is to provide the user with selectively adjustable means to position and orient the head support cushion to an infinite number of positions as desired for the utmost comfort and ergonomic stability.

A further object is the provision of a plurality of apertures arranged in a peg-board style arrangement employed on the body of the device that allows users to engage hooks and other hanging means for luggage to allow the weight of such to be born by the wheelchair.

These together with other objects and advantages which become subsequently apparent reside in the details of the construction and operation of the invention, as more fully hereinafter described and claimed herein, without being in any manner considered limiting in scope, with reference being had to the accompanying drawings forming a part thereof, wherein like numerals refer to like parts throughout.

BRIEF DESCRIPTION OF DRAWING FIGURES

DETAILED DESCRIPTION OF THE PREFERRED EMBODIMENTS OF THE INVENTION

Figure 1:
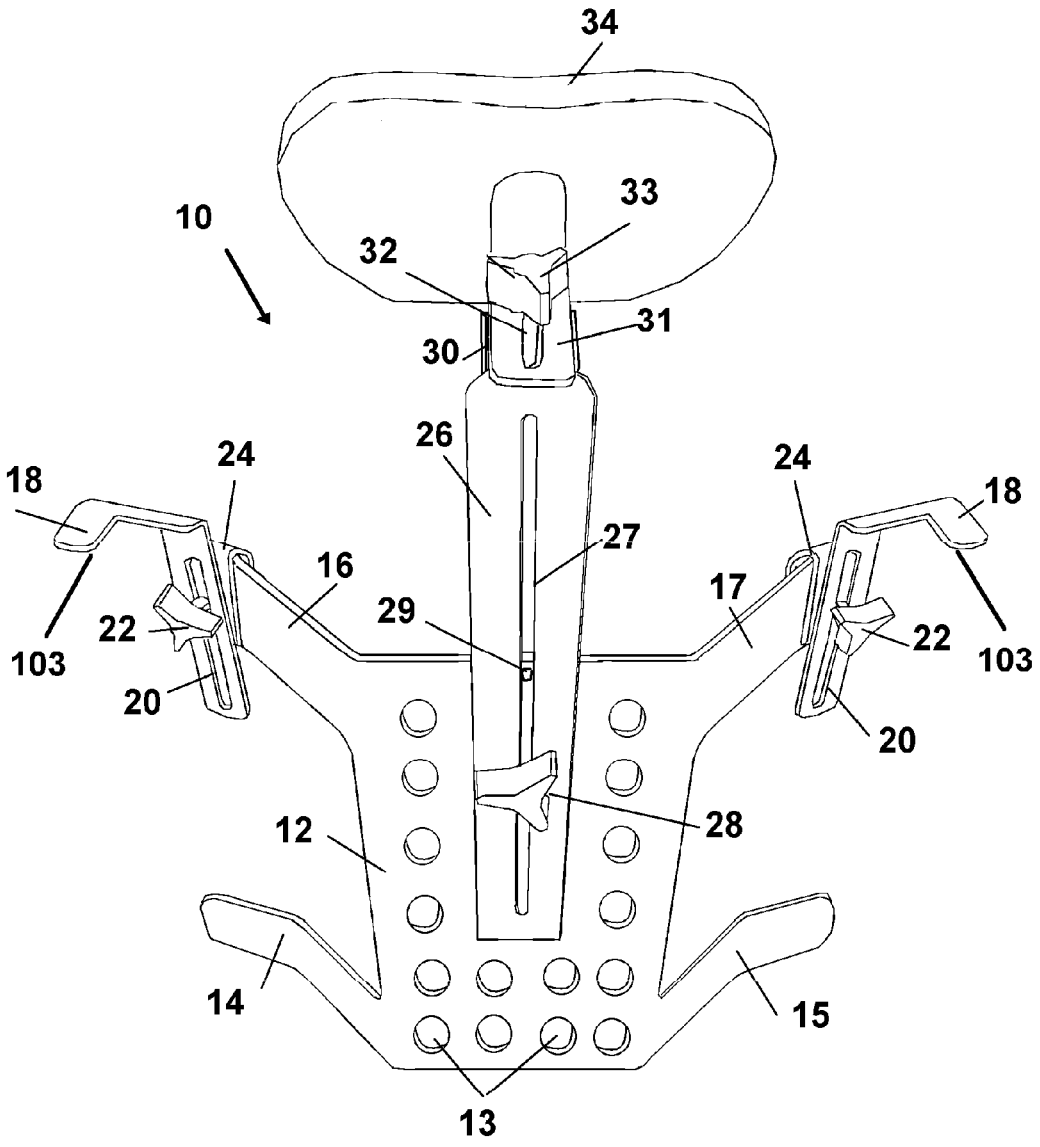
FIG. 1 shows a rear elevated view of the device detailing the various components.
Figure 2:
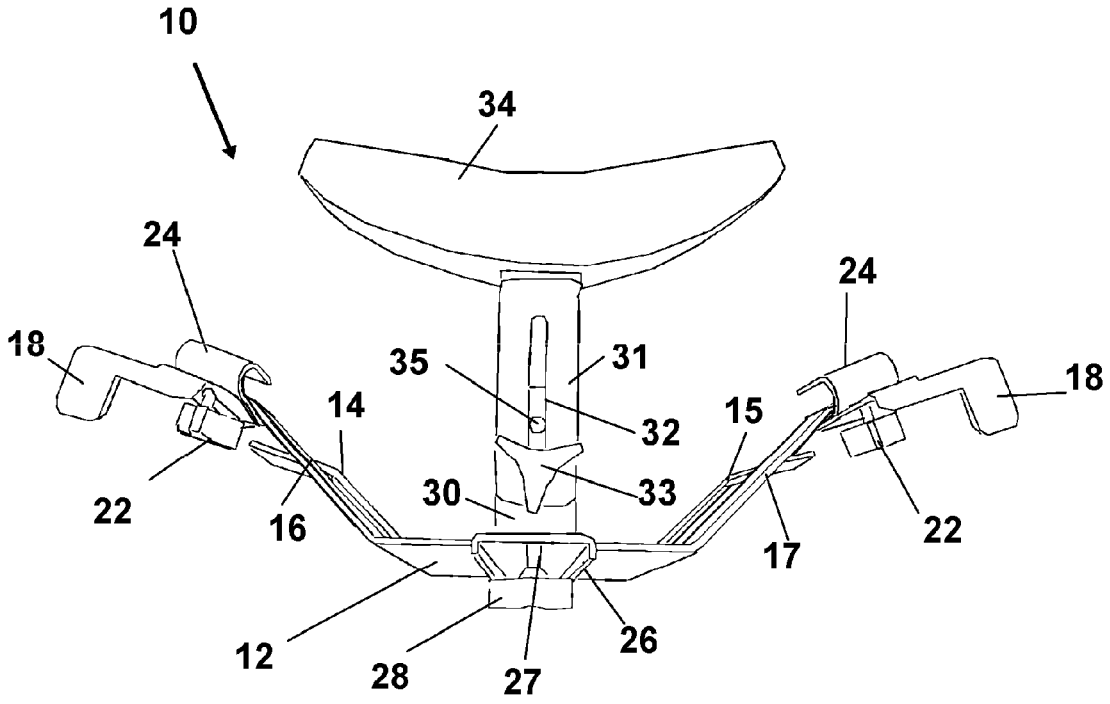
FIG. 2 is a top view of the device further detailing various components of the device.
Figure 3:
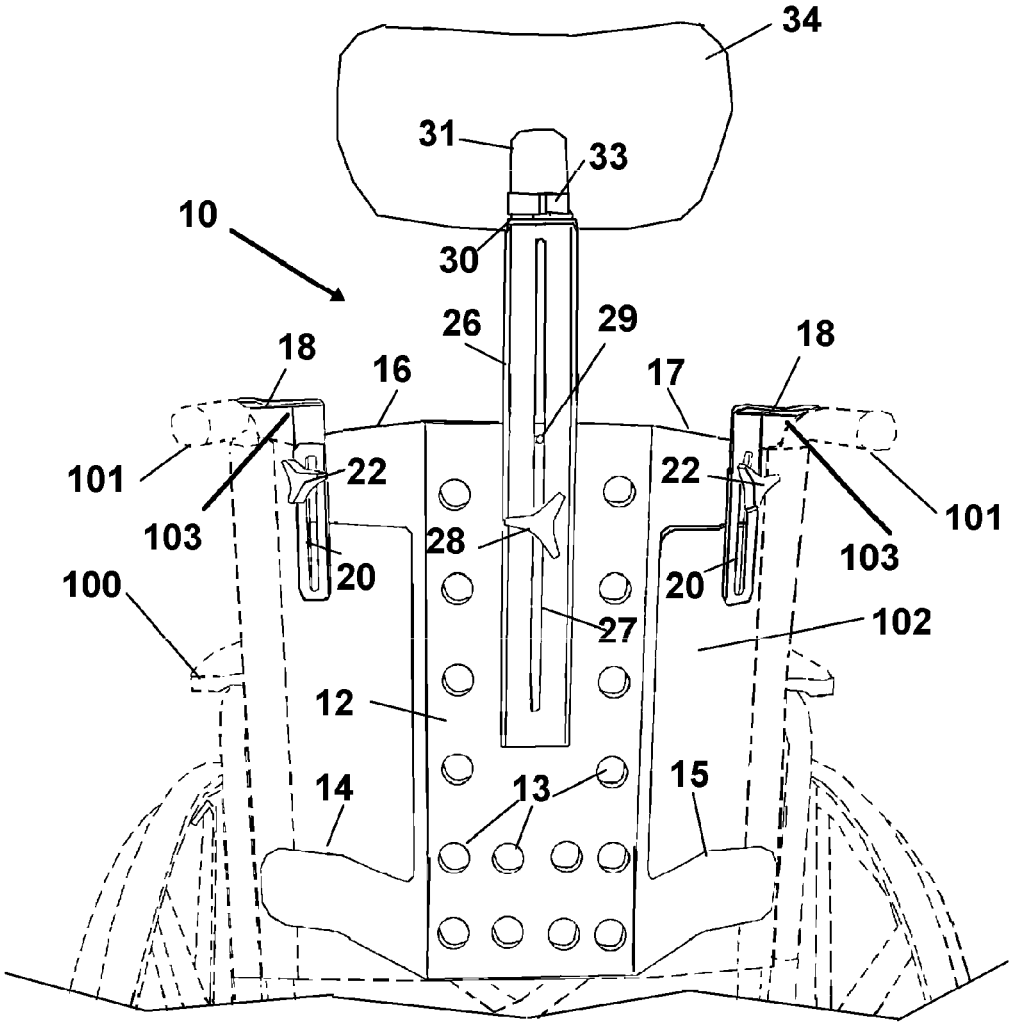
FIG. 3 depicts the view of the device in the as used mode engaged to a wheelchair.

Now referring to drawings in FIGS. 1-3, wherein similar components are identified by like reference numerals, there is seen in FIG. 1, a rearward elevated view of the device 10. Preferably, the device 10 is of a sturdy lightweight material such as but not limited to one or a combination of support materials from a group including stainless steal, aluminum, carbon fiber, magnesium alloy, and reinforced plastic. From the body 12 portion of the device 10 extends a first extending lower arm 14 and a second 15 extending lower arm along with first extending upper arm 16 and second extending upper arm 17, all of which extend from an engagement to the body 12 at a first end, in a direction away from an imaginary central axis running through an elongated slot 27 to respective distal ends.

This plurality of arms provide a means to support the device 10 against the collapsible or other frame which support a canvas back and seat of a wheelchair 100 (FIG. 3) as well as position the device 10 when engaged to the wheelchair 100 in an as-used position such as in FIG. 3, at a considerable distance rearward from the fabric 102 forming the seat back portion of the wheelchair 100. This spacing is important so as to avoid obstruction or contact with the back of the resting position of the user while seated in the wheelchair 100. This feature is best depicted in FIG. 2 described shortly.

The upper extending arms 16,17 further are configured to employ a means for removable engagement with the backrest portion of the wheelchair 100 while concurrently communicating the weight of the device 10 to the frame of the chair to avoid harming or stretching the fabric portions. Particularly preferred in all modes of the device 10, are lateral extending support members 18 which are shaped to overhang the top surfaces of the handles 101 (FIG. 3) of the wheelchair 100 to which the device 10 engages.

These support members 18 provide a means for removable weight bearing engagement to the handles 101 of the wheelchair 100, and thereby communicate substantially the entire weight of the device 10, and any luggage or items attached to the device 10, to the frame of the wheelchair. This removable weight bearing engagement is accomplished by extending above and lowering upon the push handles 101 portions (FIG. 3) of the wheelchair when the device is engaged to the as-used position shown in FIG. 3.

This supported or weight bearing engagement of the top surfaces of push handles 101 with the support members 18 provides a means to communicate the weight of the device 10 and any other weight engaged to the device 10 such as the user's head, or luggage engaged thereon, from the body 12 and to the handles 101 where it may be born by the rigid frame of the wheelchair. The support members 18 are preferably selectively adjustable by a translation in the vertical direction parallel to the axis defined by the slot 27. They may also be made to rotate in their connection to the body 12 parallel to the plane of the planar body 12 to which they connect. This provides a means to raise and lower the support members 18 to align with the handles 101 and also a means to rotate them to be further from or closer to the axis running through the slot 27 again to provide alignment over the top edge of the handles 101 when being placed to the as-used position.

Vertical translation as well as rotation are currently accomplished using means for translational and rotational mounting to the body 12 which in the current form is accomplished via an operative slot 20 that slidably and rotationally engages them to the body 12 whereafter they may be secured in their adjusted positions by compression provided by turn screw 22. Those skilled in the art will realize upon reading this specification that other modes of translational and rotational engagement to the body 12 may be employed such as hinges, vertical and horizontal slots, translation upon the upper arms 16 and 17, and forming the distal ends of the support members in a telescopic fashion and allowing for a lengthening to allow for more adaptability of the device to a wider array of chairs. It must be noted that those skilled in the art may recognize other means to provide adjustability and adaptability as needed, and are anticipated.

Similarly located on the upper edge of the extending arms 16 and 17, are the curved members 24 providing a hook which provide a means for removable engagement to the terminating top edge of the wheelchair seat back fabric (FIG. 3). These hook-shaped curved members 24 operatively engage and provide a positioning of the body 12 of the device 10 just rearward of the seat back portion of the wheelchair. With the support members 18 properly translated and rotated to position them in contact with the handles 101 on each side frame of the wheelchair, when the curved members 24 are lowered over the fabric edge, a contact is made with the support members 18 to these handles 101 allowing all the weight to be communicated to and born by the handles 101 of the two side frames which are in a scissored engagement forming the collapsible wheelchair frame of conventional design. This alignment and contact thereby provide a means to maintain the fabric back unstressed during use in its natural state. Furthermore, the members 24, by adjustment of the support members 18 in their engagement to the top surface of the handles 101, are positioned near the lateral edges of the seat back fabric (FIG. 3) as to keep weight from communicating to the fabric back and to provide a free area of clearance therebetween, for the seated position of a user.

The head support means 34 is engaged to the body 12 of the device 10 through a series of slidably engaged support components. A first support component 26 is an elongated member translatably engageable to the body 12 to provide a means for vertical adjustment of the cushion providing the head support means 34. The support element 26 employs an operative slot 27 which is slidably and translatabley engaged to the body 12 of the device 10 via a turn screw 28 communicating through the slot into the body 12. A pin 29 extending through the slot 27 from engagement to the body 12 is employed at a distance near the turn screw 28 to maintain alignment during translation and prohibit rotation of the support element 26 about the turn screw 28. The turn screw, once tightened, will maintain the support element 26 in position and removably but rigidly engaged to the body 12.

A second support component 30 is engaged to the first support component 26 and extends traverse or perpendicular to the axis defined by the slot 27 of the first support component 26. A third support component 31 is further slidably engaged to the second support component 26. The third support component 31 similarly employs an operative slot 32 to translatabley engage it to the second support component 30 and may be fixed in position with an additional turn screw 33. The head support means 34 may be a cushion or similar material. Again it must be noted that those skilled in the art may recognize other means to provide adjustability and adaptability of the head support means 34, and are anticipated.

A top view of the device 10 can be seen in FIG. 2. The depiction better shows the head support means 34 and corresponding support members. The second support component 30 is shown extending in the transverse direction or perpendicular to the first support component 26. Again, the second support component 30 is engaged to the first support element 26. This engagement may be rigid or may be accomplished by employing a unitary structure in concert with the first support component 26. The third support component 31 is slidably engaged to the second support component 30 via operative slot 32 and turn screw 33. A pin 35 can be seen employed within slot 32 to prohibit rotation of the head support means 34 that is rigidly engaged to the third support element 31.

The hook shaped curved support members 24 engaged to the first 16 and second 17 upper extending arms 18 lie in a vertical plane substantially parallel with distal ends of the first 14 and second 15 lower extending arms. In this manner, upon engagement with the seat back portion of a wheelchair, the body 12 of the device 10, is maintained at a position considerably rear the plane associated with engagement of the curved members 24 and thus rearward of the fabric or other seat back portion of the wheelchair. The body 12 of the device 10 therefore does not communicate with or otherwise obstruct the body of the resting seated user.

Furthermore, in a particularly preferred mode of the device the lateral support members 18 employ a TEFLON or similar slip pad surface upon the lower surface 103 which is positioned for weight bearing contact with the top surface of the push handles 101 of the wheelchair (FIG. 3). This slip pad is of importance as it provides a means for the device 10 to move and accommodate the consistent movement of the user and seat back portion. For example, the device 10 will tend to shift horizontally and translate with the seat back portion of the wheelchair (when contacted by the weight of the back of a seated user) due to the engagement at the curved members 24 therewith. Further, the upright supports for the fabric seatback can shift and draw the handles 101 slightly closer and toward the axis defining the slot 27. As such, this shifting motion will be accommodated allowing the wheelchair to react naturally as designed and contract with weight, by the lateral support members 18 which may slide on the push handles 101 in a manner consistent with the motion of the seat back. This slip-accommodating engagement is much preferred to a non-slip engagement of the lateral members 18 to the push handles, such as with clamps, fittings, or fasteners, where the natural designed motion of the fabric and frame chair would be resisted, making the chair ride uncomfortable and also acting prevent strain of the users head against the head support means 34 as they lean back, for instance. Further, by allowing for a slidable engagement of the device 10 to the chair, in addition to allowing the designed natural contraction and expansion action of the chair, the handles 101 will continually bear the weight of the device 10 and attachments with no fittings or permanent engagement to the handles 101. Thus, in addition to allowing for natural designed chair operation, the device 10 can be removed easily and in a matter of seconds from the chair, to allow for collapse of the chair for transport, or to allow the device to be slidably engaged with another such wheelchair 100.

FIG. 3 is a view of the device 10 in the as used mode. The device 10 is engaged on the seat back portion 102 of a wheelchair 100. The lateral support members 18 are seen in a frictional yet slidable engagement to the top surface push handle portions 101 of the wheelchair just to the rear of the seat back portion 102. Mounting is as easy as sliding the device upon the chair back until the support members 18 contact the handles 100 while the curved members 24 are aligned with the fabric of the chair back. Disengagement is in reverse.

The first 14 and second 15 lower expending arms provide support of the device 10 on the lower portion of the wheelchair seat back 102 and provide a means to prevent rearward tipping of the slidably engaged device 10 and prevent the cushion of the head support from moving away from the user's head. Selective adjustments of the lateral support members 18 are achieved via slidable engagement of the turn screw 22 with the slotted portions 20 of the members 18. Of course, other means to adjust the members 18 such as making them telescopic so as to allow lengthening or shortening thereof, or a rotatable engagement to the device 10, or combinations thereof may be employed. The major concern is to provide a means to transfer the weight of the device 10 and any attachments thereto, to the wheelchair 100 without any clamps, or fasteners, or the like which would make it hard and time consuming to remove and remount the device 10.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A support frame adapted for an engagement with a collapsible wheelchair, said support frame comprising:

a body;

holes in said body capable of supporting other items;

a pair of hook-shaped curved members for translational engagement of said support frame over an upper edge of said fabric seatback to position said support frame to a substantially vertical as-used position, engaged with said wheelchair;

a secondary support extending from said support frame, said secondary support comprising:

a first extending lower arm and a second extending lower arm extending in a transverse direction from a lower portion of the base of the support frame;

a first extending upper arm and a second extending upper arm extending in a transverse direction from an upper portion of the base of the support frame; and wherein said first extending lower arm, said second extending lower arm, said first extending upper arm and said second extending upper arm are all adapted to engage sideframes of said collapsible wheelchair said secondary support providing means to prevent rearward movement of said head support when contacted by a user's head;

a primary support extending from said support frame, said primary support comprising:

a first member extending away from a first side of said frame while in said as-used position;

a second member extending away from an opposite side of said frame while in said as-used position;

wherein said primary support is fixedly slidably vertically adjustable relative to said upper edge;

said distal end of said first member configured for said direct horizontal sliding and weight bearing engagement upon an upper surface of a first of said handlebars of sideframes of said wheelchair;

said distal end of said second member configured for said direct horizontal sliding and weight bearing engagement upon an upper surface of a second of said handlebars of said sideframes;

whereby said support frame in said as-used position communicates said weight to said handlebars of said sideframes and is removable from said as used position by raising of said support frame to concurrently disengage said translational engagement of said support frame over an edge of said fabric seatback and said direct slidable weight bearing engagement with said handlebars;

a head support extending from said upper edge of said support frame when in said as-used position, said head support comprising:

a vertical distance adjusting turn screw installed within a slot on a first vertical support component and a first pin installed on said base and within said slot on said first vertical support component;

a horizontal distance adjusting turn screw installed within a slot on a second horizontal support component and a second pin installed on a third horizontal support component and within said slot on said second horizontal support component; and wherein said head support is fixedly slidably both vertically and horizontally adjustable relative to said upper edge.

2. The support frame of claim 1 additionally comprising:

said direct horizontal sliding and weight bearing engagement upon an upper surface of a first of said handlebars of said sideframes of said wheelchair, by both said first member and second member of said primary support, allowing for a flex of said collapsible wheel chair frame and a movement of said side frames toward and away from each other with said support frame in said as-used position.

* * * * *